US010814378B2

(12) United States Patent
Valentin et al.

(10) Patent No.: US 10,814,378 B2
(45) Date of Patent: Oct. 27, 2020

(54) TOOLING FOR PRODUCING A METAL PRODUCT BY FEED CASTING

(71) Applicant: CONSTELLIUM ISSOIRE, Issoire (FR)

(72) Inventors: Bernard Valentin, Voiron (FR); Arnaud Ballu, Biviers (FR); Soizic Blais, Saint Etienne de Crossey (FR)

(73) Assignee: CONSTELLIUM ISSOIRE, Issoire (FR)

( * ) Notice: Subject to any disclaimer, the term of this patent is extended or adjusted under 35 U.S.C. 154(b) by 206 days.

(21) Appl. No.: 16/069,224

(22) PCT Filed: Jan. 27, 2017

(86) PCT No.: PCT/FR2017/050196
§ 371 (c)(1),
(2) Date: Jul. 11, 2018

(87) PCT Pub. No.: WO2017/129922
PCT Pub. Date: Aug. 3, 2017

(65) Prior Publication Data

US 2019/0022744 A1 Jan. 24, 2019

(30) Foreign Application Priority Data

Jan. 29, 2016 (FR) ..... 16 50763

(51) Int. Cl.
*B22D 11/04* (2006.01)
*B22D 11/041* (2006.01)
*B22D 11/103* (2006.01)

(52) U.S. Cl.
CPC ..... *B22D 11/0401* (2013.01); *B22D 11/04* (2013.01); *B22D 11/041* (2013.01); *B22D 11/103* (2013.01)

(58) Field of Classification Search
CPC ... B22D 11/04; B22D 11/0401; B22D 11/041; B22D 11/103
(Continued)

(56) References Cited

U.S. PATENT DOCUMENTS 3,186,042 A * 6/1965 Daley ..... B22D 7/10 277/651
3,437,308 A * 4/1969 Thiem et al. ..... B22D 7/10 249/201

(Continued)

OTHER PUBLICATIONS

International Search Report dated Mar. 28, 2017, corresponding to PCT/FR2017/050196.

*Primary Examiner* — Kevin P Kerns
(74) *Attorney, Agent, or Firm* — Ladas & Parry, LLP; Malcolm J. MacDonald

(57) ABSTRACT

A tooling for producing a metal product by feed casting, including a mold having a preheater, an ingot mold (10), a movable bottom that moves in a main direction X and a transition ring interposed between the preheater and the ingot mold (10). The tooling has a clamping ring (12) transmitting a clamping force (F1) to the transition ring (11) oriented towards the ingot mold (10), a holding mechanism that positively locks the clamping ring (12), and an axial relief mechanism configured to vary between an inactive state in which the holding mechanism exerts a holding force (F2) on the clamping ring (12) such that the clamping ring (12) exerts the clamping force (F1) on the transition ring (11) and an active state in which the axial relief mechanism resists the action applied by the holding mechanism on the clamping ring in the inactive state.

16 Claims, 4 Drawing Sheets

(58) Field of Classification Search
USPC ..... 164/444, 487, 418, 459
See application file for complete search history.

(56) References Cited

U.S. PATENT DOCUMENTS

| | | | |
|---|---|---|---|
| 6,318,449 | B1 | 11/2001 | Jolivet et al. |
| 2005/0061468 | A1 | 3/2005 | Schneider et al. |
| 2010/0051225 | A1 | 3/2010 | Scott et al. |

* cited by examiner

TOOLING FOR PRODUCING A METAL PRODUCT BY FEED CASTING

SUMMARY OF THE INVENTION

The present invention relates to a tool for manufacturing a metal product by hot top casting, including a mold comprising:

- a hot top through which the metal in liquid state is poured,
- an ingot mold in which solidification of the metal occurs, equipped with a support with integrated cooling,
- a movable base moving in a main direction at a controlled speed, in a direction away from the ingot mold as the metal solidifies,
- and a transition ring interposed between the hot top and the ingot mold.

BACKGROUND OF THE INVENTION

Experts in the field are familiar with the metal casting technique, referred to as "hot top casting" in the appropriate terminology, to manufacture a product such as a billet of metal or a metal slab: liquid metal is fed in particular by gravity into an ingot mold, arranged for example in the lower part of the mold, cooled externally and provided with a movable base. While it is in the ingot mold, the metal solidifies and is removed using the movable base while the hot top is refilled, so as to maintain an approximately constant level of liquid metal. Within hot top casting, experts in the field are familiar with vertical semi-continuous casting or "vertical casting" or horizontal semi-continuous casting or "horizontal casting". These two names are special cases of hot top casting.

It is also known to design the mold so that the ingot mold includes a graphite portion mounted internally in the support so as to be in contact with the liquid metal while it is solidifying.

The transition ring, in addition to providing the mechanical connection between the mold and the hot top, has the essential function of providing pressure tightness for the mold in the junction zone between the mold and the hot top. This problem is a particularly essential one, given the very high fluidity at casting temperature of certain aluminum alloys such as aluminum-silicon alloys. In addition, this technique induces significant metallo-static pressure in this junction zone.

Conventionally, like in the solution described in document US2010/0051225A1, the transition ring is held in place by a single clamping piece applying an axial force to it during casting, this force resulting from a load transmitted to this clamping piece by a number of bolt-type clamping systems distributed around the main direction. Conventionally, there is a number of such systems, to ensure that a predetermined clamping force is applied, uniform around the edge and constant with regard to temperature variations which are even more noticeable for large molds.

This solution involving clamping of the transition ring is reliable in practice but has the essential disadvantage of making any change of the transition ring particularly tedious and long. All the clamping systems have to be unscrewed and disassembled in order to be able to remove the clamping ring, and the opposite operation has to be carried out when tightening the new transition ring, which is hard work and requires a lot of time. In addition, poor tightening, especially due to fatigue or inattention, during the reassembly operation, may compromise the next casting.

The present invention aims to overcome some or all of the drawbacks mentioned above.

In this context, there is a need to provide tooling for the manufacture of a metal product by hot top casting, which makes changing the transition ring more user-friendly while reducing the time required for this operation and making it simpler to carry out, and ensuring good quality and a good distribution of the clamping force to ensure pressure tightness between the transition ring and the ingot mold.

To this end, a tool is proposed for manufacturing a metal product by hot top casting, including a mold comprising:

- a hot top through which the metal in liquid state is poured,
- an ingot mold in which solidification of the metal occurs, equipped with a support with integrated cooling,
- a movable base moving in a main direction, parallel to the main axis of the ingot mold,
- a transition ring interposed between the hot top and the ingot mold, the tooling comprising a clamping ring able to transmit a clamping force to the transition ring oriented towards the ingot mold in the main direction, a holding mechanism ensuring positive locking of the clamping ring and able to exert a holding force on the clamping ring directed towards the transition ring along the main direction, and an axial load-shedding mechanism configured to vary between an inactive state in which the holding mechanism exerts said holding force on the clamping ring so that the clamping ring exerts said clamping force on the transition ring, and an active state in which the axial load-shedding mechanism opposes the action applied by the holding mechanism on the clamping ring in the inactive state in order to release the clamping ring in the axial direction and to allow removal of the clamping ring from the mold such that the transition ring can be withdrawn in the main direction on the opposite side to the ingot mold.

According to a particular embodiment, the holding mechanism comprises a locking ring able to transmit said holding force to the clamping ring, and biasing means permanently acting on the locking ring in the main direction, in the direction of the clamping ring according to a compressive force such as in the inactive state of the axial load-shedding mechanism, the locking ring loaded by the biasing means according to compressive force exerts said holding force on the clamping ring.

In a first alternative embodiment, the locking ring and the clamping ring are integral with each other, in particular by being formed in a single piece.

In a second alternative embodiment, the locking ring is a part independent of the clamping ring and in its active state, the axial load-shedding mechanism temporarily biases the locking ring in the main direction in a direction opposite to the compressive force applied by the biasing means in a manner making it possible to do away with the bearing of the locking ring on the clamping ring in the main direction, to allow said withdrawal of the clamping ring from the mold.

The clamping ring and the locking ring can work in conjunction according to a locking/unlocking system.

According to a particular embodiment, the locking/unlocking system is a bayonet system, the relative angular variation between the two rings around the main direction making it possible to vary between a first angular configuration in which the clamping ring can pass through the locking ring in the main direction in an opposite direction to the transition ring, and a second angular configuration in which the clamping ring is blocked by the locking ring in the main direction in the opposite direction to the transition ring.

It can in particular be organized so that the move from the first angular configuration to the second angular configuration and vice versa is obtained by a rotational movement of the clamping ring relative to the mold around the axial direction over a predetermined angular travel, the locking ring remaining fixed relative to the mold during said movement.

According to a particular embodiment, the locking ring is integral with a piston and the axial load-shedding mechanism comprises firstly a chamber defined between said piston and the support of the ingot mold, and secondly a management system allowing the pressure in the chamber to be varied.

The management system may comprise, firstly, a device for providing a controlled supply to the chamber of a fluid such as air or oil, having a pressure making it possible to apply to the piston a force greater than the compressive force applied to the locking ring by the biasing means, and secondly a device providing controlled exhaust of said fluid out of the chamber.

According to a particular embodiment, the biasing means comprise a plurality of elastic compression devices angularly distributed around the main direction, each elastic compression device being interposed between the support of the ingot mold and the piston.

Each elastic compression device may comprise a stack of a plurality of Belleville washers parallel to the main direction.

In a particular embodiment, the mold and the clamping ring are configured so that the clamping ring is withdrawn from the mold in the main direction.

In a particular alternative embodiment, the clamping ring and the transition ring are integral with one another.

In an alternative embodiment, the clamping ring is a part independent of the transition ring.

The invention will be better understood from the following description of particular embodiments of the invention given by way of non-limiting examples and shown in the accompanying drawings, in which:

DETAILED DESCRIPTION OF THE INVENTION

Figure 1:
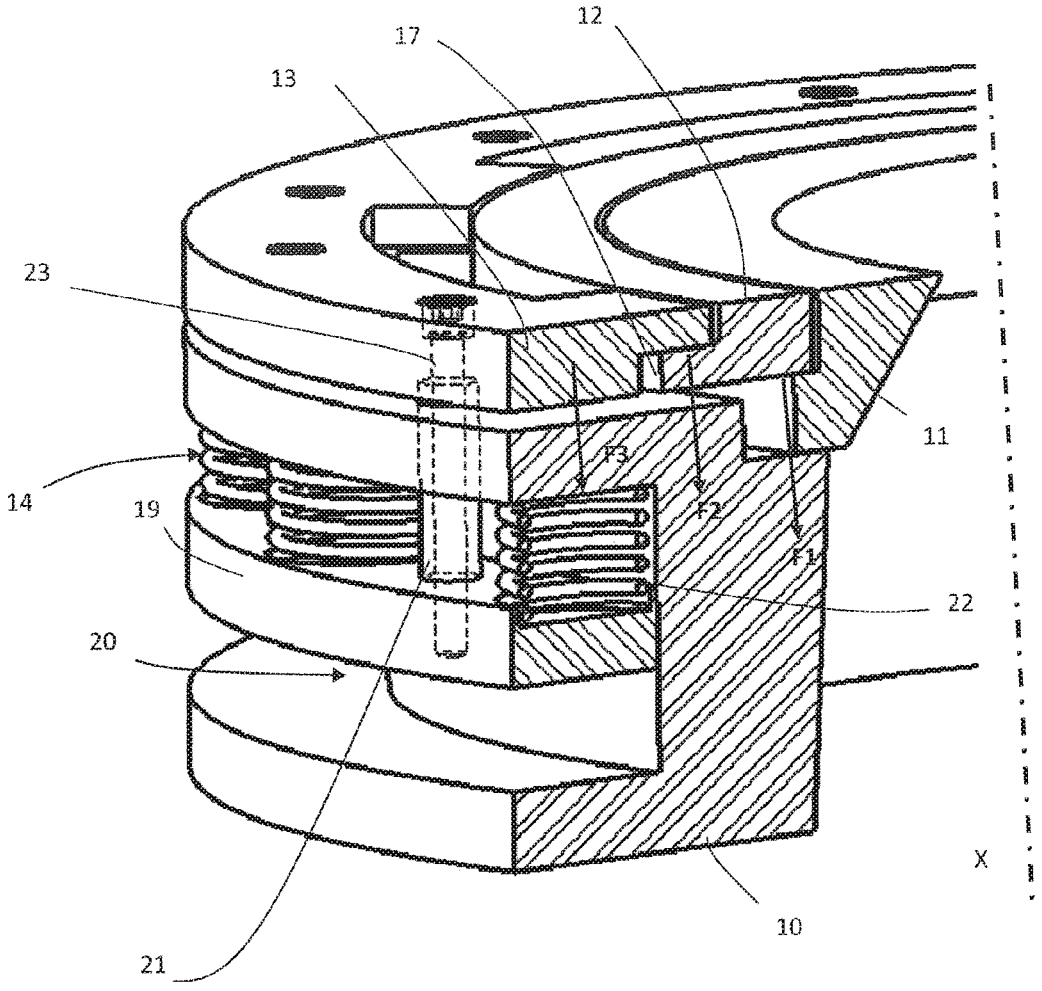
FIG. 1 is a cross-sectional view, along a section plane passing through the main direction, of an example of a manufacturing system according to the invention, whose axial load-shedding mechanism is in the inactive state.
Figure 2:
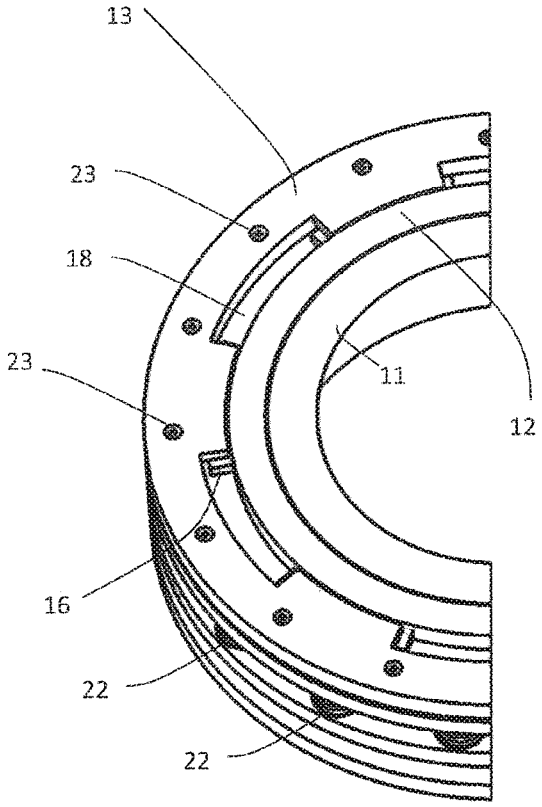
FIG. 2 is a perspective view generally from above of the locking ring, the clamping ring, the transition ring and the mold when the clamping ring and the locking ring are in their second relative angular configuration.

Referring to the accompanying FIGS. 1 to 4 as summarily presented above, the invention essentially relates to a tool for the manufacture of a metal product by hot top casting, this tool being partially shown in the figures.

The tooling comprises a mold suitable for hot top casting of a molten metal, in particular a very large amount of metal (typically several tons) in a single casting. This mold comprises:

- a hot top (not shown) into which metal in the liquid state is poured,
- an ingot mold 10 in which solidification of the metal occurs, equipped with a support with integrated cooling (not shown),
- a base (not shown) movable in relation to the ingot mold 10 in a main direction at a controlled speed, in a direction away from the ingot mold 10 as the metal solidifies,
- a transition ring 11 interposed between the hot top and the ingot mold.

Experts in the field are familiar with the metal casting technique known as "hot top casting" suitable for making a metal product such as a metal billet or a metal slab.

The type of metal may vary depending on the application. It may preferably be aluminum alloys.

A "billet" is a cylindrical piece of circular section, designed then to be sliced along its length; each slice can then be used in a subsequent extrusion operation via an extrusion die. The section of the billet depends on the section of the mold in a plane perpendicular to the axial direction.

The ingot mold 10 may also comprise a graphite portion mounted in the integrated cooling support so as to be in contact with the liquid metal. In practice, the transition ring 11 then presses onto the graphite portion of the mold 10 along the main direction X and provides pressure tightness with respect thereto.

The main direction X is oriented substantially parallel to the main axis of the ingot mold.

In the particular case of vertical casting, the main direction X is oriented substantially vertically, allowing the liquid metal in this case to flow by gravity from the hot top to the ingot mold 10, the movable base also moving in the direction of gravity.

In the particular case of horizontal casting, the main direction X is oriented substantially horizontally, allowing the liquid metal in this case to flow by gravity from the hot top to the ingot mold 10, the movable base also moving along a horizontal axis.

The means for integrated cooling of the support of the ingot mold 10 may be of any kind, such as for example internal ducts in which a cooling liquid such as water circulates.

In a preferred embodiment of the invention, corresponding to vertical casting the hot top is arranged in the upper part of the mold and the ingot mold 10 is located in the lower part of the mold. The movable base is located below the ingot mold 10, on the opposite side to the hot top and the transition ring 11. The movable base moves vertically downward as the liquid metal in the ingot mold 10 solidifies. The movable base can be controlled, in particular its speed and travel.

The tooling comprises a clamping ring 12 able to transmit a clamping force F1 to the transition ring 11, this clamping force F1 being directed towards the ingot mold 10 in the main direction X.

The tooling also comprises a holding mechanism ensuring positive locking of the clamping ring 12 bearing against the transition ring 11 in order to immobilize the transition ring 11. The holding mechanism is configured so as to exert a holding force F2 on the clamping ring 12 directed towards the transition ring 11 along the main direction X, the positive locking resulting precisely from the application of this holding force F2 on the clamping ring 12 which has the effect of applying the clamping force F1 onto the transition ring 11.

The tooling also includes an axial load-shedding mechanism configured to vary between:

an inactive state (the situation shown in FIGS. 1 and 2) in which the holding mechanism exerts the holding force F2 on the clamping ring 12 so that the clamping ring 12 exerts the clamping force F1 on the transition ring 11, and an active state (the situation shown in FIGS. 3 and 4) in which the axial load-shedding mechanism opposes the action applied by the holding mechanism on the clamping ring 12 in the inactive state of the axial load-shedding mechanism, this opposition being made so as to release the clamping ring 12 in the main direction X and to allow the clamping ring 12 to be removed from the mold, in such a way that the transition ring 11 can be removed in the main direction X from the opposite side to the ingot mold 10.

"Positive locking" means that the holding mechanism provides the function of holding the clamping ring 12 automatically, even when no action is applied to the tooling. This is also known as a fail-safe system: as long as no action is performed, the clamping ring 12 is locked in position and it is instead necessary to perform an action designed for this purpose to unlock and release the clamping ring 12. This unlocking is achieved by temporarily placing the axial load-shedding mechanism in its active state. Its inactive state, automatically occupied when no action is applied to the tooling, allows, in contrast, the holding mechanism to lock the clamping ring 12, and therefore the transition ring 11, in position, even if the load-shedding mechanism breaks or if there is a power cut or an outage of the power dedicated to the transition to the active state of the load-shedding mechanism.

In other words, the holding force F2 is automatically applied to the clamping ring 12 by the holding mechanism as soon as the axial load-shedding mechanism is in its inactive state, whereas it is no longer applied when the axial load-shedding mechanism is placed temporarily and deliberately in its active state.

According to an embodiment as shown in the accompanying figures, the clamping ring 12 is a part independent of the transition ring 11. In this case, the clamping ring 12 is in particular configured so as to bear against the transition ring 11 in the main direction X in a direction opposite to the support against the ingot mold 10. The clamping force F1 from the clamping ring 12 to the transition ring 11 is transmitted at the level of this bearing zone between the two rings 11, 12, for example in the form of an outer shoulder arranged on the edge of the transition ring 11.

Alternatively, though not shown, it may still be possible to make provision for the clamping ring 12 and the transition ring 11 to be integral with each other.

According to a particular embodiment, non-limiting as to the design freedom of the holding mechanism, the holding mechanism comprises a locking ring 13 able to transmit the holding force F2 to the clamping ring 12 and biasing means 14 permanently acting on the locking ring 13 in the main direction X towards the clamping ring 12 according to a compressive force F3 such as in the inactive state of the axial load-shedding mechanism, the locking ring 13 loaded by the biasing means 14 according to this compressive force F3 exerts the holding force F2 on the clamping ring 12.

Figure 3:
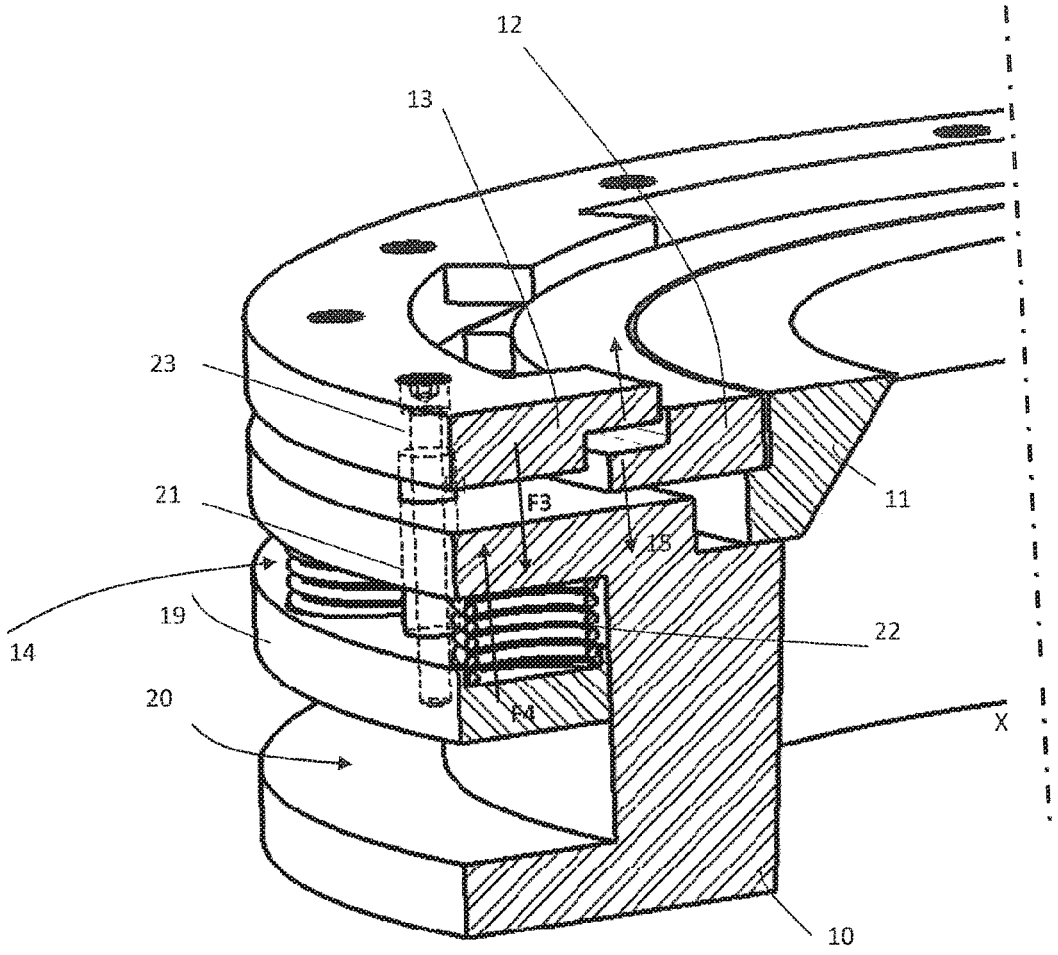
FIG. 3 is a cross-sectional view, along a section plane passing through the main direction, of the manufacturing system of FIGS. 1 and 2, when the axial load-shedding mechanism is in the active state.
Figure 4:
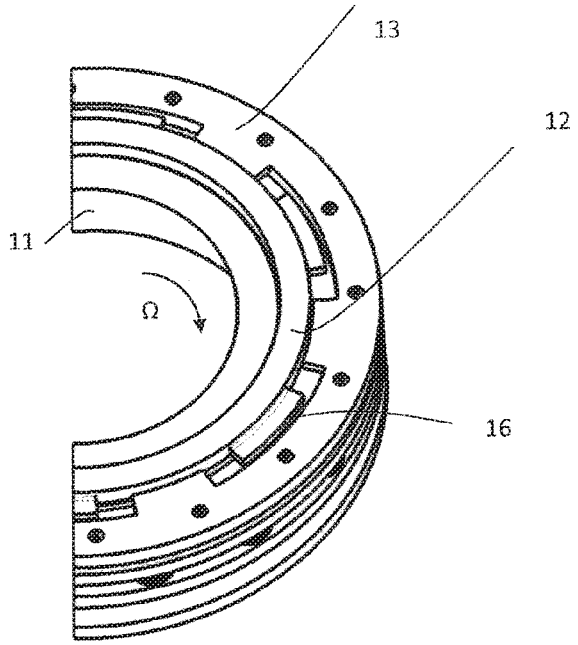
FIG. 4 is a perspective view generally from above of the locking ring, the clamping ring, the transition ring and the mold when the clamping ring and the locking ring are in their first relative angular configuration.

According to an embodiment as shown in the accompanying figures, the locking ring 13 is a part independent of the clamping ring 12. In its active state, the axial load-shedding mechanism temporarily loads the locking ring 13 along the main direction X in a direction opposite to the compressive force F3 applied by the biasing means 14 in a way that makes it possible to do away with the support of the locking ring 13 on the clamping ring 12 in the main direction X. FIGS. 3 and 4 show this situation, unlike FIGS. 1 and 2 where bearing of the locking ring 13 is in progress on the clamping ring 12. When the axial load-shedding mechanism is placed in its active state and the support of the locking ring 13 on the clamping ring 12 ceases, even leaving an axial gap 15 between the two rings 12, 13, the clamping ring 12 is no longer subject to the holding force F2 and no longer applies the clamping force F1 to the transition ring 11. The clamping ring 12 is then free axially and this allows subsequent removal of the clamping ring 12 from the mold.

The temporary loading of the locking ring 13 by the load-shedding mechanism here means that the axial load-shedding mechanism transmits a temporary force to the locking ring 13 (FIG. 3), this force having a component along the main direction X with an intensity greater than the intensity of the compressive force F3 permanently applied by the biasing means 14 on the locking ring 13.

The clamping ring 12 and the locking ring 13 work in conjunction via a locking/unlocking system configured so that, in the inactive state of the load-shedding mechanism, the locking/unlocking system cannot be activated to be in a state of unlocking the ring 12 and is, on the contrary, blocked in a state of locking the rings 12,13. When the load-shedding mechanism is active, the move of the locking/unlocking system from the locking state to the unlocking state is, on the contrary, possible.

According to a particular non-exhaustive embodiment, the locking/unlocking system is a bayonet system. The relative angular variation between the two rings 12, 13 around the main direction X makes it possible to vary between a first angular configuration (FIG. 4) in which the clamping ring 12 can pass through the locking ring 13 in the main direction X in a direction opposite to the transition ring 11, and a second angular configuration (situation shown in FIGS. 1, 2 and 3) in which the clamping ring 12 is blocked by the locking ring 13 along the main direction X in the opposite direction to the transition ring 11.

The bayonet system comprises any suitable means arranged on the locking ring 13 and/or on the clamping ring 12. The bayonet system is in particular provided with one or more pins 16, in particular integral with the clamping ring 12, which engage by rotation around the main direction X in notches 17 provided for this purpose delimited at least partially by the locking ring 13 and, as is the case here, in combination with the ingot mold 10. To allow the axial engagement of these pins 16 to a main position then allowing them to engage in the notches 17 by relative rotation between the clamping ring 12 and the locking ring 13, the locking ring 13 delimits a plurality of openings 18 angularly distributed around the main direction X, in particular arranged on an inner edge of the locking ring 13. In a plane perpendicular to the main direction X, each of these openings 18 has dimensions greater than that of the pin 16 which is designed to cross it axially. The pins 16 are here angularly distributed around the main direction X, being arranged, in particular protruding, on an inner edge of the clamping ring 12.

The move from the first angular configuration to the second angular configuration and vice versa is possible only when the axial load-shedding mechanism is in its active state. It is, however, inhibited as long as the axial load-shedding mechanism is in its inactive state, also participating in the positive blocking function conferred by the holding mechanism.

In the variant illustrated the move from the first angular configuration to the second angular configuration and vice versa is obtained by a rotational movement Ω of the clamping ring 12 relative to the mold around the axial direction X over a predetermined angular travel, the locking ring 13 remaining fixed relative to the mold during said movement Ω of the clamping ring 12.

Although the locking ring 13 has been presented as an independent part of the clamping ring 12, it remains possible to make provision alternately for the locking ring 13 and the clamping ring 12 to be integral with each other, in particular by being formed from a single part.

According to a particular embodiment facilitating the use of the axial load-shedding mechanism and the positively locking holding mechanism, the locking ring 13 is integral with a piston 19 able to move in the main direction X over a determined travel, delimited between two limit stops integral with the ingot mold 10.

In a preferred embodiment of the invention, the locking ring 13 and the piston 19 are held at a predetermined distance by means of a set of spacers 21 and screws 23. It can then be understood that in this case, the holding mechanism comprises the locking ring 13, the piston 19, spacers 21 and screws 23, which make this assembly integral.

The axial load-shedding mechanism comprises firstly a chamber 20 delimited between the piston 19 and the support of the ingot mold 10, and secondly a management system (not shown) for varying the internal pressure inside the chamber 20.

The management system comprises, firstly, a device for providing a controlled supply to the chamber 20 of a fluid such as air or oil, having a pressure making it possible to apply to the piston 19 a force F4 greater than the compressive force F3 applied to the locking ring 13 by the biasing means 14, and secondly a device providing controlled exhaust of this fluid out of the chamber 20 when it is desired to put the load-shedding mechanism in its inactive state.

In practice in the example embodiment illustrated, the biasing means 14 are interposed between the ingot mold 10 and the piston 19. The forces generated by the biasing means 14 are transmitted to the piston 19, the latter driving the locking ring 13 which is integral with it, so as to apply the compressive force F3 to it. Through the piston 19, the biasing means 14 therefore apply the compressive force F3 to the locking ring 13.

It follows from the foregoing that the total force transmitted at each instant by the piston 19 to the locking ring 13 is equal to the sum of the forces F3 applied by the set of biasing means 14 in proportion to the prestress applied by the set of screws (23), within the limit of travel imposed by the length of the spacers (21).

In the inactive state of the load-shedding mechanism, the total effort is therefore equal to the compressive force F3, whereas in its active state, the total force corresponds to an effort opposite to the direction of the force F3 and having an intensity equal to the difference between the intensity of the force F4 applied in the chamber 20 and the intensity of the compressive force F3. Forces F4 are transmitted only in the active state of the load-shedding mechanism.

The biasing means 14 are able to deform in the same direction as the forces to which they are subjected; from the inactive configuration (in their natural state) to the occupied inactive configuration of the load-shedding mechanism and the inactive configuration of the load-shedding mechanism in the active configuration.

In the inactive state of the load-shedding mechanism, the biasing means 14 are compressed according to a force F3, less than the maximum force allowed by said means.

In the active state of the unloading mechanism, the intensity of the force F4 ranges between the force F3 and the maximum allowable force of the biasing means. In a preferred embodiment of the invention, the displacement of the holding system induced by the force F4 makes it possible to eliminate the contact between parts 12 and 13.

Piston 19 comprises a plurality of spacers 21 oriented parallel to the main direction X and whose upper end coincides with the locking ring 13. The number of spacers 21 is for example greater than or equal to 3 or more preferably greater than or equal to 10. Spacers 21 are distributed angularly around the main direction X, with a regular pitch. These spacers 21 serve to transmit the forces undergone by the piston 19 to the locking ring 13, namely the forces permanently coming from the biasing means 14 and the forces applied by the load-shedding mechanism via the fluid in the chamber 20 only in the active state of the load-shedding mechanism. Their number and their distribution make it possible to transmit very high forces while having a good distribution of the latter over the entire edge of the locking ring 13. Spacers 21 are also slidably mounted in the ingot mold 10, in particular by passing through the thickness of the support of the ingot mold 10 in its upper part. In this way, they also provide the slidably mounting function of the locking ring 13 relative to the ingot mold 10 in the main direction X.

According to a particular embodiment, the biasing means 14 comprise a plurality of elastic compression devices 22 angularly distributed around the main direction X, each elastic compression device 22 being interposed between the support of the ingot mold 10 and the piston 19. The number of elastic compression devices 22 is for example greater than or equal to 3 or more preferably greater than or equal to 10. The elastic compression devices 22 are distributed angularly around the main direction X, with or without a regular pitch. Their number and their distribution make it possible to transmit very high forces while having a good distribution of the latter over the entire edge of the locking ring 13.

Each elastic compression device 22 comprises in particular a stack of a plurality of so-called "Belleville" washers parallel to the main direction X, which makes for very high efficiency while maintaining a good level of simplicity and reliability over time. It remains true, however, that an elastic compression device 22 may optionally comprise a coil spring or any other compressible element able to play an elastic role under the effect of very high compressive forces F3.

It is recalled that a "Belleville" washer is a slightly conical washer made from a stamped sheet, used to act as a compressive spring.

The clamping ring 12 is withdrawn from the mold when the load-shedding mechanism is in the active position by unlocking the locking/unlocking system.

In the particular case of a bayonet locking/unlocking system, the clamping ring 12 is withdrawn from the mold when the unloading mechanism is in the active position, by the combination of the main direction X with a rotational movement Ω, until an alignment in the main direction X is obtained between the pins 16 of the clamping ring 12 with the openings 18 of the locking ring 13.

The way that the tooling which has just been described operates may be as follows.

In order to manufacture a metal product using the tooling, liquid metal is brought in particular by gravity to the ingot mold 10, cooled externally and provided with a movable base. While it is in the mold 10, the metal solidifies and is removed along the main direction X using the movable base, while the hot top located in the upper part of the mold is refilled so as to maintain an approximately constant level of liquid metal in spite of the movable base going down.

Depending on the nature and design of the ingot mold 10, the metal product that can be manufactured in this way may be a metal billet or a metal slab, which metal may be an aluminum alloy for example.

During hot top casting, the holding mechanism loads the clamping ring 12 by applying the holding force F2 to it. Under the effect of this holding force F2, the clamping ring 12 applies clamping force F1 to the transition ring 11 which fulfills its role of pressure tightness with regard to the ingot mold 10.

To do this, the forces transmitted to the piston 19 by the load-shedding mechanism permanently apply the compressive force F3 to the locking ring 13. During the hot top casting phase, the axial load-shedding mechanism is in the inactive state (FIG. 1). Piston 19 does not undergo any force F4 by the fluid contained in the chamber 20. Under the effect of the mere presence of the compressive force F3, the locking ring 13 is lowered and bears against the clamping ring 12 and transmits thereto the holding force F2, which is substantially equal to the compressive force F3.

The clamping ring 12 and the locking ring 13 are locked by the locking/unlocking system. The rings 12 and 13 are axially locked to ensure the transmission of forces from one part to another (FIG. 2) and prevent any withdrawal of the clamping ring 12.

When the transition ring 11 has to be exchanged at the end of a hot top casting operation, the axial load-shedding mechanism is placed temporarily and deliberately in its active state (FIG. 3). The fluid contained in the chamber 20 transmits force F4 to the piston 19, piston 19 already undergoing the compressive force F3 coming from the biasing means 14. This effort F4 is opposite to, and greater than the compressive force F3. This results in a lifting movement of the locking ring 13 and bearing on the clamping ring 12 ceases. The holding force F2 is no longer transmitted to the clamping ring 12, so the clamping force F1 is no longer transmitted to the transition ring 11. The clamping ring 12 becomes free axially.

At the same time, in a particular embodiment of the invention, as the holding force F2 is no longer transmitted to the clamping ring 12, the locking ring 13 becomes axially free.

In another preferred particular embodiment, as the holding force F2 is no longer transmitted to the clamping ring 12, said clamping ring 12 becomes axially free. In the particular case of a bayonet locking/unlocking system, the clamping ring 12 becomes free angularly around the main direction X.

The clamping ring 12 is then withdrawn from the main direction X passing through the locking ring 13 by means of a suitable extraction tool (not shown). Once the clamping ring 12 has been withdrawn in this way, the transition ring 11 can be extracted along the main direction X on the opposite side to the ingot mold 10, in particular by passing through the opening in the center of the locking ring 13.

The new transition ring 11 is refitted according to a procedure carrying out the preceding steps in a reverse order.

The tooling that has just been described above has the advantage of being particularly user-friendly when changing the transition ring 11. It also makes it possible to reduce the time required for the transition ring 11 changing operation, and to make it very simple to use. These advantages are obtained without compromising either the good quality or the good distribution of the pressure tightness between the transition ring 11 and the ingot mold 10.

The invention claimed is:

1. A tooling for manufacturing a metal product by hot top casting, including a mold, said tooling comprising:

a hot top through which a metal in liquid state is poured, an ingot mold in which solidification of the metal occurs, equipped with a support with integrated cooling, a movable base moving in a main direction, parallel to a main axis of the ingot mold, a transition ring interposed between the hot top and the ingot mold, wherein the tooling comprises a clamping ring able to transmit a clamping force to the transition ring oriented towards the ingot mold in the main direction, a holding mechanism ensuring positive locking of the clamping ring and able to exert a holding force on the clamping ring directed towards the transition ring along the main direction, and an axial load-shedding mechanism configured to vary between an inactive state in which the holding mechanism exerts said holding force on the clamping ring so that the clamping ring exerts said clamping force on the transition ring, and an active state in which the axial load-shedding mechanism opposes an action applied by the holding mechanism on the clamping ring in the inactive state in order to release the clamping ring in an axial direction and to allow removal of the clamping ring from the mold such that the transition ring is withdrawn in the main direction on an opposite side to the ingot mold.

2. The tooling according to claim 1, wherein the holding mechanism comprises a locking ring able to transmit the holding force to the clamping ring and biasing means continuously loading the locking ring in the main direction towards the clamping ring according to a compressive force such that in the inactive state of the axial load-shedding mechanism, the locking ring loaded by the biasing means according to said compressive force exerts said holding force on the clamping ring.

3. The tooling according to claim 2, wherein the locking ring and the clamping ring are integral with each other.

4. The tooling according to claim 2, wherein the locking ring is an independent part of the clamping ring and in its active state, the axial load shedding mechanism temporarily biases the locking ring in the main direction in a direction opposite to the compressive force applied by the biasing means, without a need for a bearing of the locking ring on the clamping ring in the main direction, to allow withdrawal of the clamping ring from the mold.

5. The tooling according to claim 4, wherein the clamping ring and the locking ring work in conjunction according to a locking/unlocking system.

6. The tooling according to claim 5, wherein the locking/unlocking system is a bayonet system, a relative angular variation between the two rings around the main direction making it possible to vary between a first angular configuration in which the clamping ring can passes through the locking ring in the main direction in an opposite direction to the transition ring, and a second angular configuration in which the clamping ring is blocked by the locking ring along the main direction in the opposite direction to the transition ring.

7. The tooling according to claim 6, wherein a move from the first angular configuration to the second angular configuration and vice versa is obtained by a rotational movement of the clamping ring relative to the mold around the main direction over a predetermined angular travel, the locking ring remaining fixed relative to the mold during said movement.

8. The tooling according to claim 2, wherein the locking ring and the clamping ring are formed in a single piece.

9. The tooling according to claim 1, wherein the locking ring is integral with a piston and the axial load-shedding mechanism comprises:

a chamber defined between said piston and the support of the ingot mold, and a management system allowing a pressure in the chamber to be varied.

10. The tooling according to claim 9, wherein the management system comprises:

a device for providing a controlled supply to the chamber of a fluid having a pressure, making it possible to apply to the piston a force greater than the compressive force applied to the locking ring by the biasing means, and a device providing controlled exhaust of said fluid out of the chamber.

11. The tooling according to claim 10, wherein the fluid is air or oil.

12. The tooling according to claim 9, wherein the biasing means comprise a plurality of elastic compression devices angularly distributed around the main direction, each elastic compression device being interposed between the support of the ingot mold and the piston.

13. The tooling according to claim 12, wherein each elastic compression device comprises a stack of a plurality of Belleville washers parallel to the main direction.

14. The tooling according to claim 1, wherein the mold and the clamping ring are configured so that the clamping ring is withdrawn from the mold in the main direction.

15. The tooling according to claim 1, wherein the clamping ring and the transition ring are integral with each other.

16. The tooling according to claim 1, wherein the clamping ring is an independent part of the transition ring.

* * * * *